US006928706B2

(12) United States Patent
Acton et al.

(10) Patent No.: US 6,928,706 B2
(45) **Date of Patent: *Aug. 16, 2005**

(54) QUICK CHANGE CASKET CORNER ATTACHMENT MECHANISM

(75) Inventors: Troy D. Acton, St. Paul, IN (US); Brian K. Groemminger, Batesville, IN (US); Timothy Edward Hixson, Oldenburg, IN (US); James Tucker, New Palestine, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/426,170

(22) Filed: Apr. 29, 2003

(65) Prior Publication Data

US 2003/0192155 A1 Oct. 16, 2003

Related U.S. Application Data

(63) Continuation-in-part of application No. 09/660,574, filed on Sep. 13, 2000, now Pat. No. 6,591,466.

(51) Int. Cl.[7] ..... A61G 17/00
(52) U.S. Cl. ..... 27/10
(58) Field of Search ..... 27/10, 2; D99/13; 52/287.1; 403/353

(56) References Cited

U.S. PATENT DOCUMENTS

| | | | | | |
|---|---|---|---|---|---|
| 2,106,695 | A | * | 1/1938 | Larson | 27/10 |
| 2,141,734 | A | | 12/1938 | Besch | |
| 2,213,506 | A | * | 9/1940 | Thoresen | 27/10 |
| 2,450,091 | A | | 9/1948 | Kendall | |
| 3,025,624 | A | | 3/1962 | Harrell | |
| 3,962,761 | A | | 6/1976 | Boughner | |
| 4,185,422 | A | | 1/1980 | Radek | |
| 4,195,394 | A | | 4/1980 | Semon | |
| 4,225,265 | A | * | 9/1980 | Hooker et al. | 403/353 |
| 4,363,581 | A | | 12/1982 | Pease | |
| 4,473,316 | A | | 9/1984 | Welch | |
| 4,571,790 | A | * | 2/1986 | James, III | 27/10 |
| 5,335,402 | A | | 8/1994 | Semon | |
| 5,604,965 | A | | 2/1997 | Shaw et al. | |
| 5,624,045 | A | * | 4/1997 | Highsmith et al. | 211/192 |
| 5,716,154 | A | | 2/1998 | Miller et al. | |
| 5,960,524 | A | | 10/1999 | Darby et al. | |
| 6,109,819 | A | | 8/2000 | Welch | |
| 6,138,335 | A | * | 10/2000 | Drawbaugh et al. | 27/10 |
| 6,196,758 | B1 | | 3/2001 | Scarborough | |
| 6,317,945 | B1 | * | 11/2001 | Laphan et al. | 27/10 |

FOREIGN PATENT DOCUMENTS

| | | | |
|---|---|---|---|
| CA | 2242113 A1 | | 2/2000 |
| CA | 2279703 A1 | * | 2/2000 |

* cited by examiner

*Primary Examiner*—William L. Miller
(74) *Attorney, Agent, or Firm*—Wood, Herron & Evans, L.L.P.

(57) ABSTRACT

An ornamental corner piece for attachment to a casket includes a back plate which is adapted to mount to the corner of a casket. An attachment clip is operatively mounted within an elongated groove in the back plate. The clip member has at least one keyhole groove comprising an opening and a slot. An ornamental corner insert with at least one attachment member selectively slidingly engages the keyhole groove in the attachment clip such that the ornamental corner insert may be selectively mounted to or removed from the back plate. The attachment clip includes an indexing member. When the attachment clip is installed, the indexing member extends into a throughhole in the elongated groove in the back plate. The indexing member properly orients the attachment clip in the elongated groove. Other embodiments of the invention are also disclosed.

18 Claims, 6 Drawing Sheets

QUICK CHANGE CASKET CORNER ATTACHMENT MECHANISM

RELATED APPLICATIONS

This application is a continuation-in-part of application Ser. No. 09/660,574 filed Sep. 13, 2000, now U.S. Pat. No. 6,591,466 issued Jul. 15, 2003, hereby incorporated by reference.

FIELD OF THE INVENTION

The present invention relates generally to caskets, and, more specifically, to apparatus for attaching decorative corner trim pieces to the corners of a casket.

BACKGROUND OF THE INVENTION

Some casket designs incorporate decorative or ornamental corner pieces secured to the casket during fabrication thereof. In many, if not most, prior designs, these ornamental corner pieces are rigidly affixed to the casket shell. Consequently, if a customer purchasing the casket is not pleased with the particular pre-installed ornamental corner pieces, and wishes to customize the casket exterior to his or her taste, the funeral director must go through a lengthy and complicated process to first remove the original ornamental corner pieces and then reinstall the ornamental corner pieces chosen by the customer. This process typically requires manual manipulation and access to the interior of the casket which may require the removal of bedding, lining, and the like. Such a process is time consuming and can damage the otherwise new casket and is thus frowned upon and generally avoided by the funeral director.

To more effectively market caskets, the funeral director desires to offer a wide variety of ornamental corner pieces from which a customer can select according to the customer's taste. However, to offer such a wide selection, and to avoid the undesirable practice mentioned above, the funeral director would have to maintain a large inventory of many different casket material/finish and corner piece combinations, which is also undesirable. To minimize the required inventory of finished caskets, the funeral director could simply have one casket of each material/finish provided that the funeral director had some means providing for the quick and efficient changing of the ornamental corner pieces on each casket. As such, the customer could quickly view numerous corner pieces on a single casket, and the funeral director would need only stock a single casket of each material/finish. Prior casket designs, which rigidly affix the ornamental corner pieces, do not permit such quick and efficient changing of the ornamental corner pieces as discussed above.

What is needed, therefore, is an attachment mechanism to permit the quick and efficient installation and removal of ornamental corner pieces onto and from caskets. The attachment mechanism should also permit attachment of existing ornamental corner pieces which are designed to be rigidly attached, i.e., allow for retrofitting of current fixed corner pieces such that they, too, are quickly and efficiently installed and removed.

SUMMARY OF INVENTION

The present invention overcomes the shortcomings of prior ornamental corner pieces. In accordance with the principles of the present invention, the ornamental corner piece includes a back plate which is adapted to mount to the corner of a casket. An attachment clip is operatively mounted within an elongated groove in the back plate. The clip member has at least one keyhole groove comprising an opening and a slot. An ornamental corner insert has at least one attachment member which selectively slidingly engages the keyhole groove in the attachment clip such that the ornamental corner insert may be selectively mounted to or removed from the back plate. Advantageously, the attachment member is a shoulder screw having a head sized to fit through the opening and be held by the slot. The slot includes protrusions which act to positively secure the shoulder screw into the slot.

In one aspect of the invention, the attachment clip includes an indexing member. When the attachment clip is installed, the indexing member extends into a throughhole in the elongated groove in the back plate. The indexing member properly orients the attachment clip in the elongated groove. Advantageously, the indexing member is positioned closer to one end of the attachment clip than the other. As such, the attachment clip can be inserted into the elongated groove in only one orientation. By allowing the attachment clip to be oriented in only one orientation, the ornamental corner insert is always installed or removed in a standard method. For example, the ornamental corner insert might always be installed by slidingly engaging the attachment clip from left to right and removed by slidingly disengaging the attachment clip from right to left.

In another embodiment of the invention, the ornamental corner piece includes a base member which is adapted to mount to the corner of a casket. A back plate operatively mounts to the base member. An ornamental corner insert having at least one attachment member selectively slidingly engages a keyhole groove in the back plate such that the ornamental corner insert may be selectively mounted to or removed from the back plate.

In still another aspect of the invention, a casket includes a shell having a pair of side walls and a pair of end walls. At least one corner is disposed between adjacent side walls and end walls such that the corner is angled relative to them both. The corner includes at least one keyhole grove. The casket further includes an ornamental corner insert having a front and a back side. The ornamental corner insert includes at least one attachment member on its back side. The attachment member is adapted to be removeably slidingly received in the keyhole groove via a sliding motion which is parallel to a plane defined by the corner. Advantageously, the attachment member is a shoulder screw. The casket may include a back plate which is operatively mounted to the corner. The back plate, not the corner, includes the keyhole groove for receiving the attachment member.

In yet another embodiment of the invention, a casket comprises a shell, an ornament, a first attachment element operably associated with the shell and a second attachment element operably associated with the ornament. The first and second attachment elements removably secure the ornament to the shell. The first and second attachment elements are configured such that the ornament is removably secured to the shell via motion in first and second non-parallel directions generally parallel to a plane defined by the first attachment element.

The first attachment element is preferably a plate with at least one groove therein and the second attachment element is preferably at least one stud. The groove preferably includes a first keyhole portion and a second non-keyhole portion. The first keyhole portion has a first longitudinal axis, the second non-keyhole portion has a second longitudinal axis, and preferably the first and second longitudinal axes are non-parallel. Preferably, the first and second longitudinal axes are perpendicular. The stud is preferably a screw, for example a shoulder screw. The motion in the first and second directions is preferably rectilinear.

In still another embodiment of the invention, apparatus for removably securing an ornament to a casket shell comprises a first attachment element adapted to be operably associated with the shell and a second attachment element adapted to be operably associated with the ornament. The first and second attachment elements are configured such that the ornament is removably secured to the shell via motion in first and second nonparallel directions generally parallel to a plane defined by the first attachment element.

Various additional advantages, objects and features of the invention will become more readily apparent to those of ordinary skill in the art upon consideration of the following detailed description of the presently preferred embodiments taken in conjunction with the accompanying drawings.

DETAILED DESCRIPTION OF DRAWINGS

DETAILED DESCRIPTION OF PREFERRED EMBODIMENTS

Figure 1:
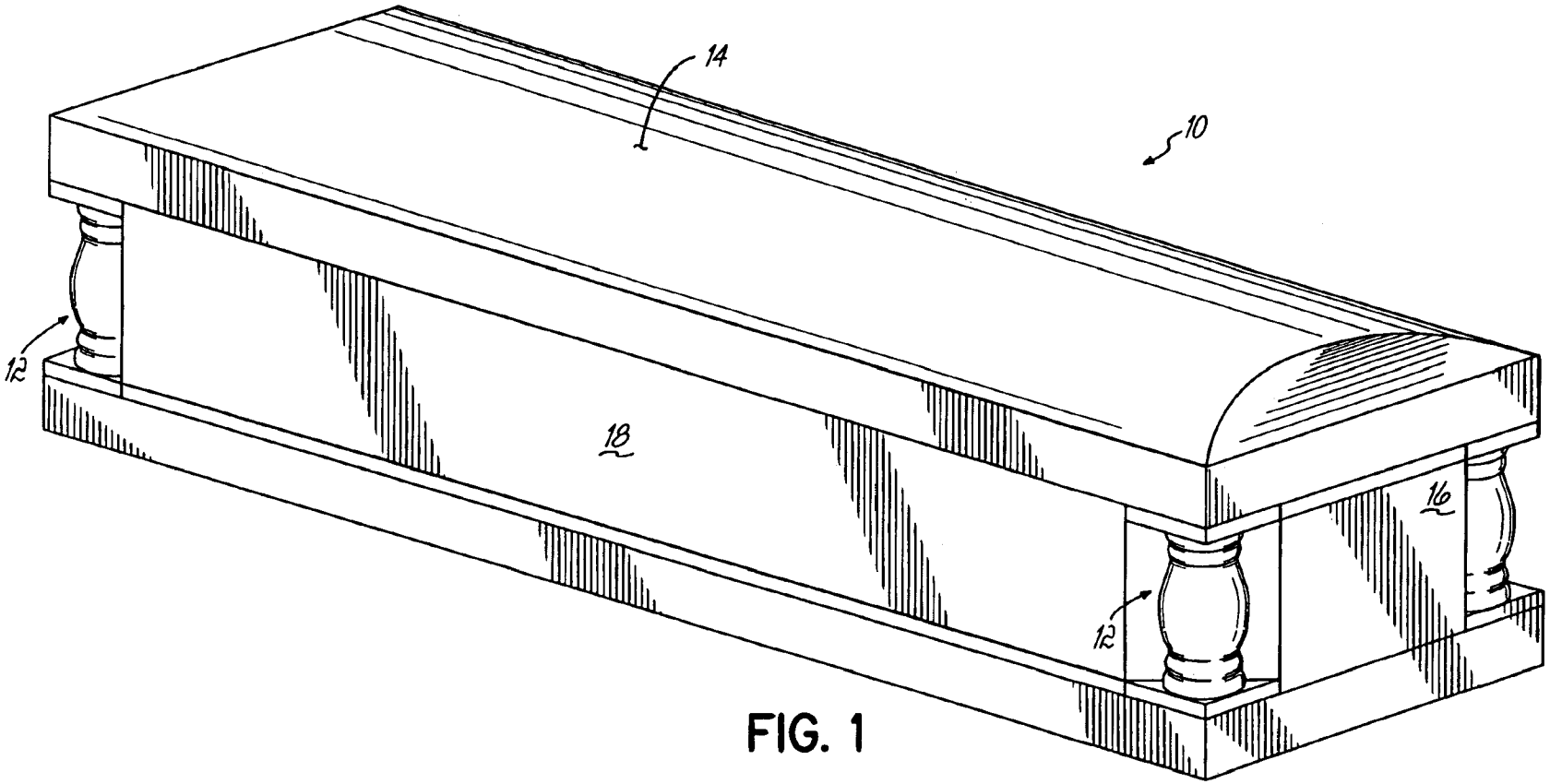
FIG. 1 is a perspective view of a casket embodying the corner attachment mechanism of the present invention.

With reference to FIG. 1, a casket 10 is shown incorporating the corner attachment mechanism 12 of the present invention. The casket has a top 14, a pair of oppositely disposed end walls 16 and two oppositely disposed side walls 18. Advantageously, the casket 10 may be made from wood, although the corner attachment mechanism 12 is not limited to use on wooden caskets, i.e., the corner attachment mechanism 12 has equal applicability to metal caskets.

Figure 2:
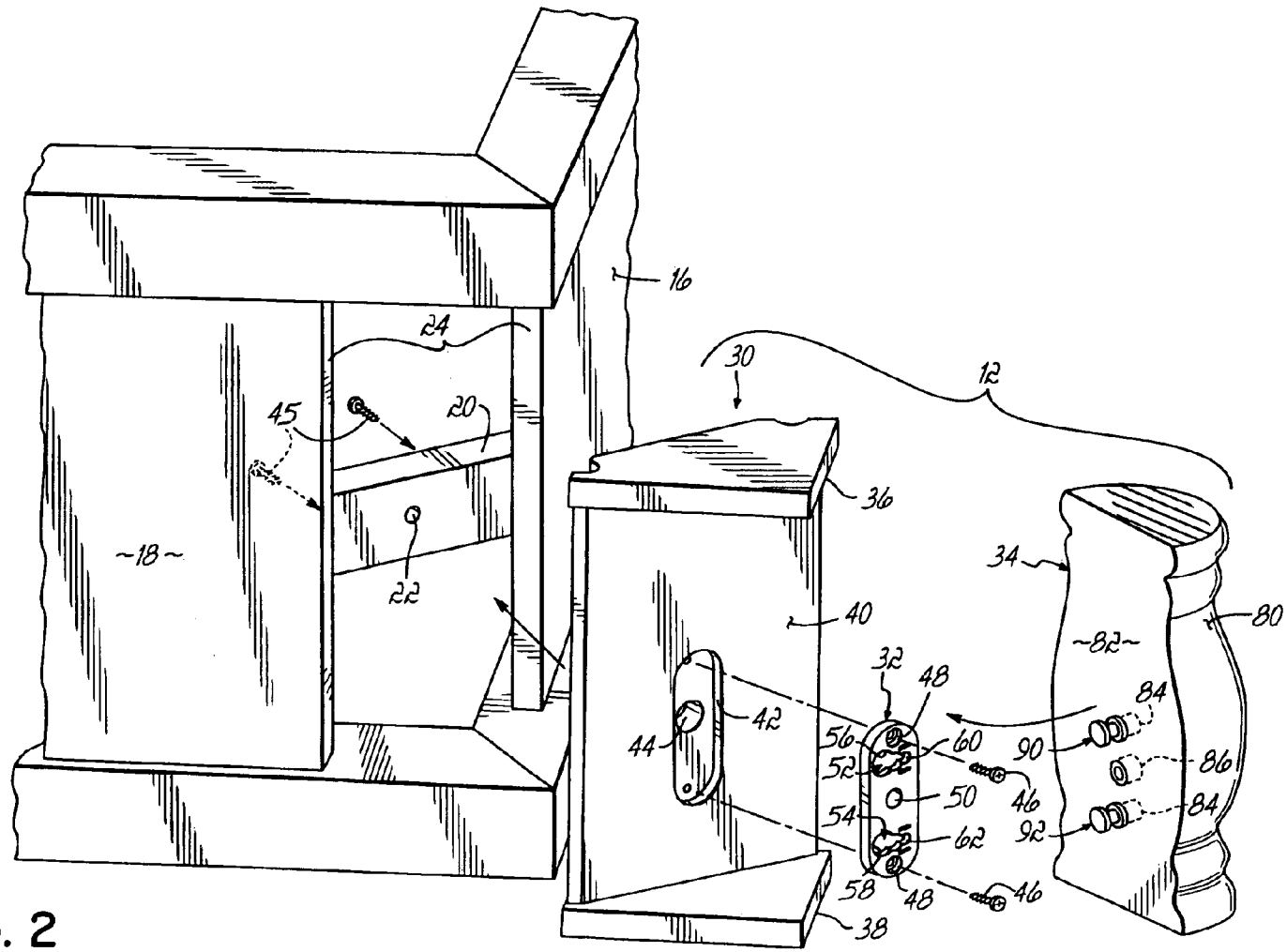
FIG. 2 is a disassembled perspective of the corner attachment mechanism shown in FIG. 1.
Figure 3:
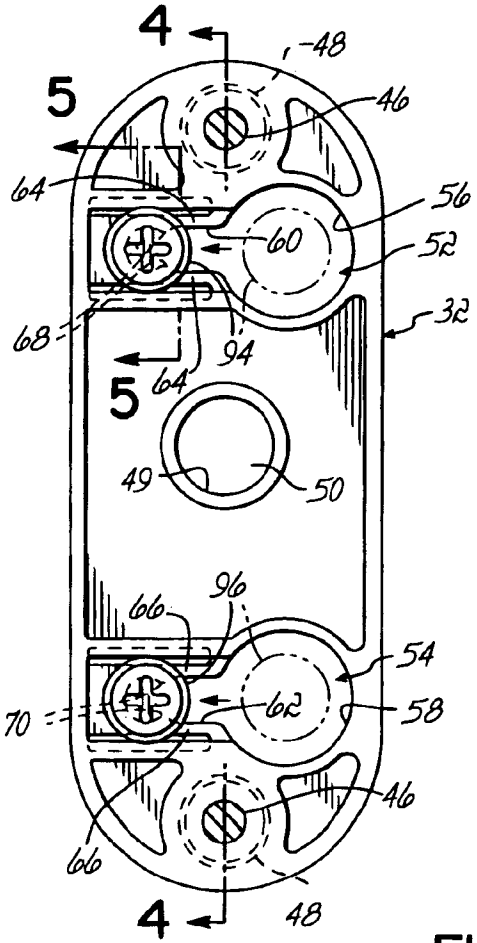
FIG. 3 is a plan view of the attachment clip shown in FIG. 2.

With further reference to FIG. 2, end walls 16 and side walls 18 are joined by brace or mounting member 20. Brace 20 includes throughhole 22 which, as described below, is sometimes used to mount corner attachment mechanism 12 to the casket 10. The ends of end wall 16 and side wall 18 do not meet such that an opening 24 is formed which provides access to the interior of the casket 10. Corner attachment mechanism 12 includes a back plate 30, an attachment clip 32, and an ornamental corner insert 34. The back plate 30 includes end pieces 36, 38 joined by vertical member 40. Vertical member 40 includes an elongated groove 42 with a throughhole 44 extending from the front side of the vertical member 40 to the back side of vertical member 40. Vertical member 40 is secured to brace 20 by fasteners 45. Fasteners 45 could be screws, nails, brads and the like, but are preferably screws. Vertical member 40 is preferably wood but could be made from any suitable structural material such as steel, aluminum, plastic or the like.

With reference to FIGS. 2–5, attachment clip 32 is sized to rest within and conform to the elongated groove 42. Attachment clip 32 is removably affixed to vertical member 40 with fasteners 46 inserted through throughholes 48 in attachment clip 32. Fasteners 46 are preferably screws. Attachment clip 32 includes an indexing member 49 (FIG. 4) with throughhole 50 which aligns with and penetrates throughhole 44 when attachment clip 32 is placed into elongated grove 42. Indexing member 49 is positioned closer to the upper end of attachment clip 32 than the lower end. As a result of the offset position of indexing member 49, the attachment clip 32 can be inserted into elongated groove 42 in only one orientation. As such, the installation and removal of the ornamental corner insert 34 will be consistent for all caskets 10. That is, the ornamental corner insert 34 will always be installed by sliding it from left to right and removed by sliding it from right to left.

Figure 5:
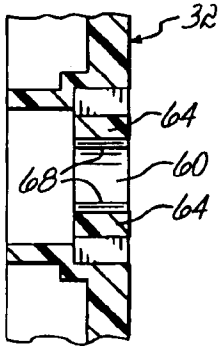
FIG. 5 is a partial cross-sectional view of the corner attachment mechanism of FIG. 3 taken along line 5—5 with the screw removed for clarity.
Figure 4:
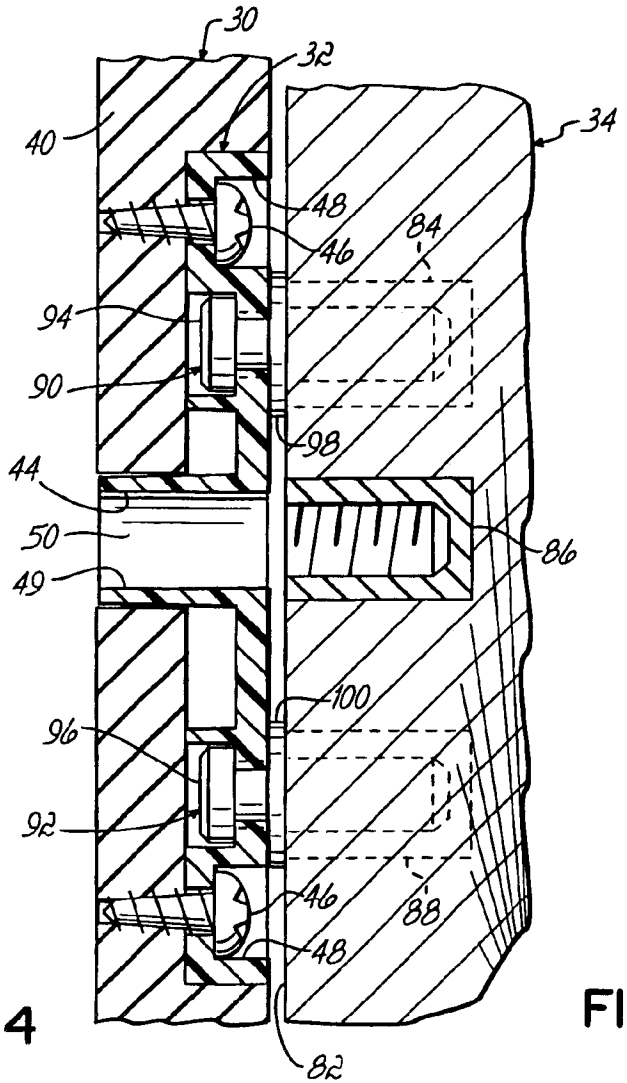
FIG. 4 is a partial cross-sectional view of the assembled corner attachment mechanism of FIG. 3 taken along line 4—4.

With specific reference to FIGS. 4 and 5, attachment clip 32 further includes two keyhole grooves 52, 54. Keyhole grooves 52, 54 include, respectively, openings 56, 58 and slots 60, 62. Slots 60, 62 are partly formed by oppositely disposed rib members 64, 66. Each rib member 64, 66 includes a protrusion 68, 70. As will be explained in greater detail below, protrusions 68, 70 assist in attaching ornamental corner insert 34 to the attachment clip 32.

Ornamental corner insert 34 includes a decorative or ornamental side 80 and a mounting side 82. Generally, the decorative side 80 can be of any aesthetically pleasing shape. Mounting side 82, however, is preferably, but not necessarily, flat so that the ornamental corner insert 34 can be flushly mounted to vertical member 40. Threaded inserts 84, 86, 88 are flush mounted to mounting side 82. As shown in FIG. 2, fasteners, and, preferably, shoulder screws 90, 92, are threaded into threaded inserts 84, 88. Shoulder screws 90, 92 include heads 94, 96 and shoulder members 98, 100. Preferably, the shoulder screws are #14–10 type A, blunt tip shoulder screws sold by Modular Systems, Inc. of Fruitport, Mich. Heads 94, 96 are sized in order that they may fit through openings 56, 58 but not fit through rib members 64, 66. Accordingly, to attach ornamental corner insert 34 to back plate 30, the heads 94, 96 of shoulder screws 90, 92 are inserted into openings 56, 58. The ornamental corner insert 34 is then moved from left to right, as viewed in FIG. 2, such that the protrusions 68, 70 on rib members 64, 66 positively engage the shoulder screws 90, 92 to hold them in slots 60, 62. To remove the ornamental corner insert 34 and possibly replace it with one of a different design, the ornamental corner insert 34 is moved from right to left until heads 94, 96 are allowed to escape through openings 56, 58.

Figure 6:
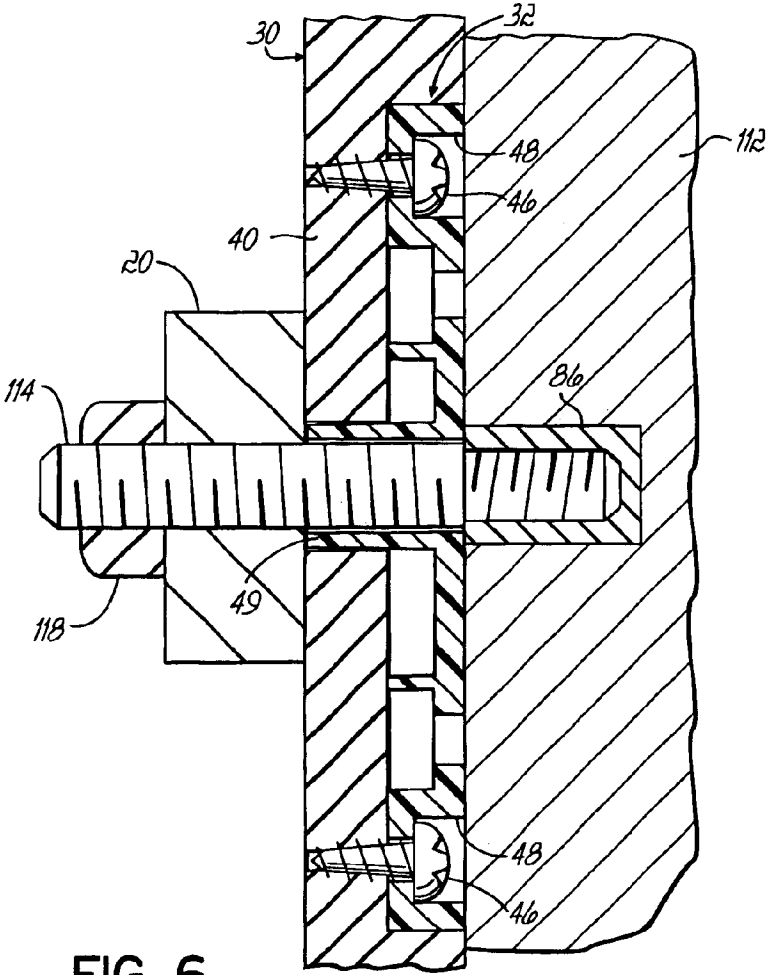
FIG. 6 is a partial cross-sectional view of another assembled corner attachment mechanism similar to the one in FIG. 4.

Advantageously, the design of back plate 30 and attachment clip 32 may accommodate former ornamental corner inserts which do not incorporate shoulder screws 90,92. These former ornamental corner inserts typically have only a threaded rod protruding from its back for securing it to the corner of a casket. As such and with reference to FIG. 6, a former ornamental corner insert 112 is shown without inserts 84, 88. In this configuration, only threaded insert is present to receive threaded rod 114. To install ornamental corner insert 112 to casket 10, threaded rod 114 is inserted through indexing member 49 and throughhole 22 of brace 20. Wing nut 118 threadingly engages threaded rod 114 to secure ornamental corner insert 112 to back plate 30. Former ornamental corner insert 112 is representative of the corner inserts which must be rigidly affixed to the corner of caskets. Judicious placement of indexing member 49 allows the former style ornamental corner inserts 112 to be used with attachment clip 32 and back plate 30, i.e. be retrofitted according to the principles of the present invention. Alternatively threaded insert 86 can be eliminated, with the threaded screw being screwed directly into the wood, plastic or metal insert.

Figure 7:
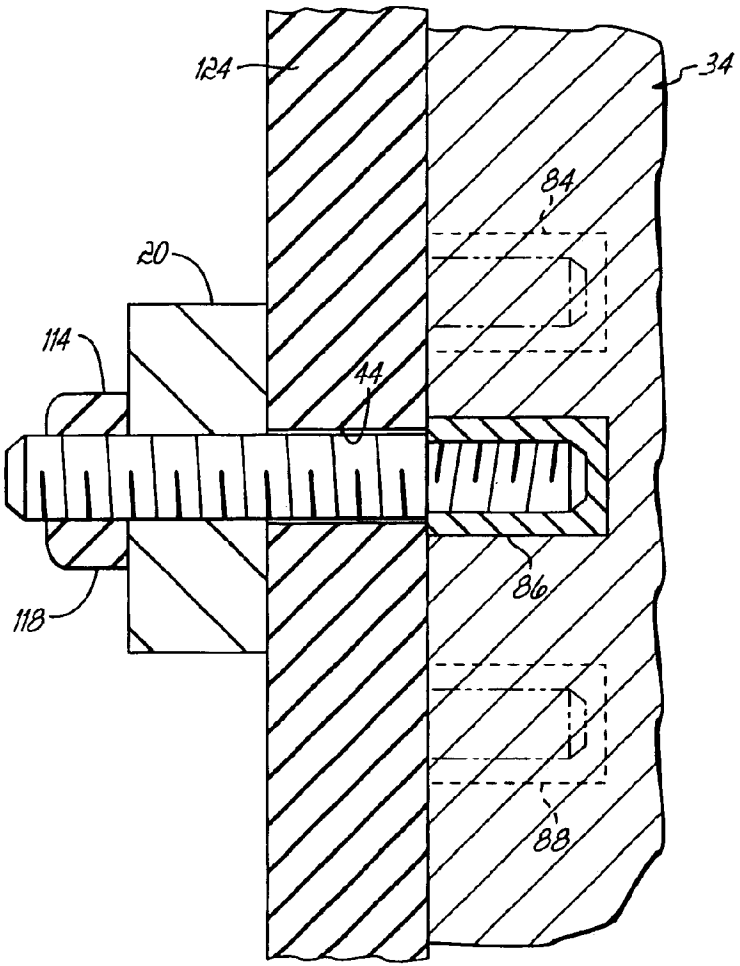
FIG. 7 is a partial cross-sectional view of the ornamental corner insert of FIG. 4 affixed to a casket corner without using the attachment clip of FIG. 3.

Advantageously, ornamental corner insert 34 may be installed onto casket corners not incorporating back plate 30 and attachment clip 32. That is, ornamental corner insert 34 of the present invention is not restricted to use with only back plate 30 and attachment clip 32. Importantly, ornamental corner insert 34 may be used on caskets which were initially constructed using former ornamental corner insert 112. Accordingly and with reference to FIG. 7, the ornamental corner insert 34 is shown affixed to a back plate 124. Back plate 124 is representative of back plates used previously in conjunction with former ornamental corner insert 112. Back plate 124 is similar to back plate 30; however, back plate 124 does not include elongated groove 42. Because back plate 124 does not include a place to secure attachment clip 32, shoulder screws 90, 92 cannot be used to secure ornamental corner insert 34 to back plate 124. As such, shoulder screws 90, 92 are removed and threaded rod 114 is threaded into threaded insert 86. To install ornamental corner insert 34 to back plate 124, threaded rod 114 is inserted through throughhole 44 and throughhole 22 and held in place with threaded wing nut 118. The benefit of using the shoulder screws in conjunction with attachment clip 32 is that the ornamental corner insert 34 can be installed and removed quickly and efficiently without having to access the interior of the casket 10. The embodiments shown in FIGS. 5 and 6, however, require the use of hand tools and access to the interior of the casket 10 in order that wing nut 118 can be threaded onto threaded rod 114.

The embodiments referenced in FIGS. 2–7 are preferably used with a casket 10 constructed of wood. Another embodiment of the present invention is used on a casket formed from sheet metal, e.g., steel or aluminum. Accordingly, and with reference to FIG. 8, a casket 128 made from steel is shown with a corner attachment mechanism 130. The corner attachment mechanism 130 includes a base or mounting member 132, a back plate 134 and an ornamental corner insert 136. Base 132 is affixed to the corner of casket 128 with fasteners, preferably screws, 138. Base 132 and back plate are preferably made from plastic. Integrally molded within back plate 134 are keyhole grooves 140, 142 which are similar to the geometry of keyhole grooves 52, 54. More specifically, keyhole grooves 140, 142 include openings 144, 146 and slots 148, 150 which are similar to openings 56, 58 and slots 60, 62. Back plate 134 also includes a plurality of oppositely disposed fastening members 152 which engage oppositely disposed slots 154 along the vertical edges of base 132 to secure back plate 134 to base 132. In this embodiment, back plate 134 does not include throughhole 44. As such, the ornamental corner insert 112, having only threaded insert 86, cannot be attached to base 132. Like the attachment clip 32 of FIG. 2, the back plate 134 permits the ornamental corner insert 136 to be installed from left to right and removed from right to left. For example, to install the ornamental corner insert 136, the heads 94, 96 are inserted into openings 144, 146 of keyhole grooves 140, 142 and slid from left to right across slots 148, 150.

Figure 10:
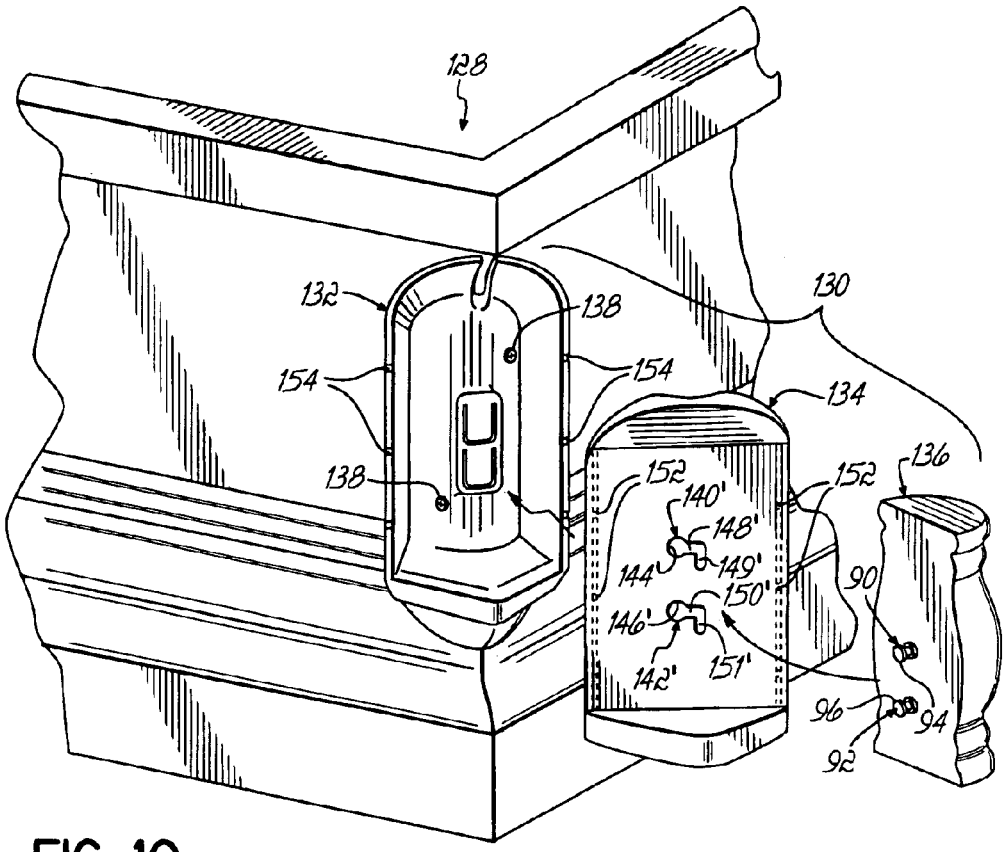
FIG. 10 is a view similar to FIG. 8 of yet another embodiment of the corner attachment mechanism of the present invention.

Referring now to FIG. 10, there is illustrated yet another embodiment of the present invention for use on sheet metal caskets. With like numbers representing like elements, the primary difference between the FIG. 10 embodiment and the FIG. 8 embodiment is the design and construction of the grooves 140' and 142' in the plate 134. More particularly, groove 140' includes a first keyhole portion comprising opening 144' and slot 148', and a second non-keyhole portion comprising slot 149'. Similarly, groove 142' includes a first keyhole portion comprising opening 146' and slot 150', and a second non-keyhole portion comprising slot 151'. As illustrated, the longitudinal axis of slot 149' is perpendicular to the longitudinal axis of slot 148'. Similarly, the longitudinal axis of slot 151' is perpendicular to the longitudinal axis of slot 150'.

To install the casket corner ornament 136, the heads 94, 96 are inserted into openings 144', 146' of grooves 140', 142'; ornament 136 is then moved generally parallel to a plane defined by plate 134 from left to right thus sliding heads 94, 96 from left to right in slots 148', 150'. The ornament 136 is then moved again generally parallel to the plane defined by plate 134 downwardly thus sliding heads 94, 96 down in slots 149', 151'. The multi-direction movement to install ornament 136 in the FIG. 10 embodiment reduces the potential for the ornament 136 to become inadvertently dislodged from plate 134.

While the two directions of motion to install the ornament 136 in the FIG. 10 embodiment have been illustrated as being perpendicular, the openings, grooves, etc. could as well be configured such that the directions of motion were not perpendicular, but simply non-parallel. Furthermore, while the motions to install ornament 136 in the FIG. 10 embodiment have been illustrated as being rectilinear, the openings, grooves, etc. could as well be configured such that the motions were not rectilinear, but curvilinear. All such variations are within the scope of the present invention.

While the present invention has been illustrated by a description of various preferred embodiments and while these embodiments have been described in considerable detail in order to describe the best mode of practicing the invention, it is not the intention of the applicants to restrict or in any way limit the scope of the appended claims to such detail. Additional advantages and modifications within the spirit and scope of the invention will readily appear to those skilled in the art. The invention itself should only be defined by the appended claims, wherein we claim:

What is claimed is:

1. A casket comprising:

a shell;

an ornament;

a first attachment element operably associated with said shell; and a second attachment element operably associated with said ornament;

said first and second attachment elements for removably securing said ornament to said shell;

said first and second attachment elements configured such that said ornament is removably secured to said shell via motion in first and second non-parallel directions generally parallel to a plane defined by said first attachment element.

2. The casket of claim 1 wherein said first attachment element is a plate with at least one groove therein and said second attachment element is at least one stud.

3. The casket of claim 2 wherein said at least one groove includes a first keyhole portion and a second non-keyhole portion.

4. The casket of claim 3 wherein said first keyhole portion has a first longitudinal axis, said second non-keyhole portion has a second longitudinal axis and said first and second longitudinal axes are non-parallel.

5. The casket of claim 4 wherein said first and second longitudinal axes are perpendicular.

6. The casket of claim 2 wherein said at least one stud is a shoulder screw.

7. The casket of claim 1 wherein said motion in said first and second directions is rectilinear.

8. A casket comprising:

a shell having a pair of side waits and a pair of end walls;

a mounting member disposed between adjacent ones of said side walls and said end walls;

an ornament;

a first attachment element operably associated with said mounting member; and a second attachment element operably associated with said ornament;

said first and second attachment elements for removably securing said ornament to said shell;

one of said first and second attachment elements being at least one groove and the other of said first and second attachment elements being at least one stud;

wherein said at least one groove is associated with said mounting member and said at least one stud is associated with said ornament; and wherein said at least one groove is formed in a plate which is secured to said mounting member.

9. A casket comprising:

a shell having a pair of side walls and a pair of end walls;

a mounting member disposed between adjacent ones of said side walls and said end walls;

an ornament;

a first attachment element operably associated with said mounting member; and a second attachment element operably associated with said ornament;

said first and second attachment elements for removably securing said ornament to said shell; and one of said first and second attachment elements being at least one groove and the other of said first and second attachment elements being at least one stud;

wherein said at least one stud is a shoulder screw.

10. Apparatus for removably securing an ornament to a casket shell comprising:

a fist attachment element adapted to be operably associated with the shell; and a second attachment element adapted to be operably associated with the ornament;

said first and second attachment elements configured such that the ornament is removably secured to the shell via motion in first and second non-parallel directions generally parallel to a plane defined by said first attachment element.

11. The apparatus of claim 10 wherein said first attachment element is a plate with at least one groove therein and said second attachment element is at least one stud.

12. The apparatus of claim 11 wherein said at least one groove includes a first keyhole portion and a second non-keyhole portion.

13. The apparatus of claim 12 wherein said first keyhole portion has a first longitudinal axis, said second non-keyhole portion has a second longitudinal axis and said first and second longitudinal axes are non-parallel.

14. The apparatus of claim 13 wherein said first and second longitudinal axes are perpendicular.

15. The apparatus of claim 11 wherein said at least one stud is a shoulder screw.

16. The apparatus of claim 10 wherein said motion in said first and second directions is rectilinear.

17. Apparatus for removably securing an ornament to a casket shell, the casket shell having a pair of side walls, a pair of end walls and a mounting member disposed between adjacent ones of the side and end walls, said apparatus comprising:

a first attachment element adapted to be operably associated with the mounting member; and a second attachment element adapted to be operably associated with the ornament;

said first and second attachment elements for removably securing the ornament to the shell;

one of said first and second attachment elements being at least one groove and the other of said first and second attachment elements being at least one stud;

wherein said first and second attachment elements are configured such that the ornament is removably secured to the shell via motion generally parallel to a plane defined by the mounting member; and the apparatus of claim 23 wherein said at least one groove is associated with the mounting member and said at least one stud is associated with the ornament;

wherein said at least one groove is formed in a plate which is secured to the mounting member.

18. Apparatus for removably securing an ornament to a casket shell, the casket shell having a pair of side walls, a pair of end walls and a mounting member disposed between adjacent ones of the side and end walls, said apparatus comprising;

a first attachment element adapted to be operably associated with the mounting member; and a second attachment element adapted to be operably associated with the ornament;

said first and second attachment elements for removably securing the ornament to the shell;

one of said first and second attachment elements being at least one groove and the other of said first and second attachment elements being at least one stud;

wherein said at least one stud is a shoulder screw.

* * * * *

UNITED STATES PATENT AND TRADEMARK OFFICE

CERTIFICATE OF CORRECTION

PATENT NO. : 6,928,706 B2
APPLICATION NO. : 10/426170
DATED : August 16, 2005
INVENTOR(S) : Acton et al.

Figure 8:
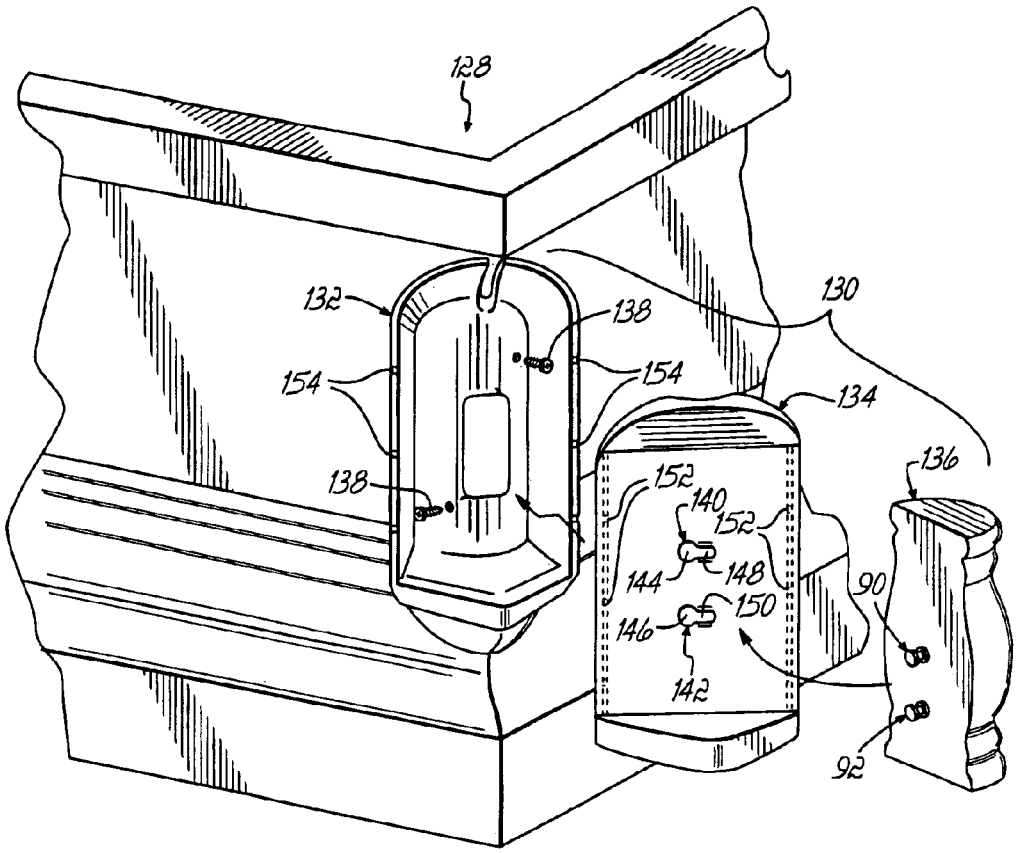
FIG. 8 is disassembled perspective view of another embodiment of the corner attachment mechanism of the present invention.

It is certified that error appears in the above-identified patent and that said Letters Patent is hereby corrected as shown below:

Column 3, line 41, reads: "Fig. 8 is disassembled perspective view of another"; it should read: -- Fig. 8 is a disassembled perspective view of another --.

Figure 9:
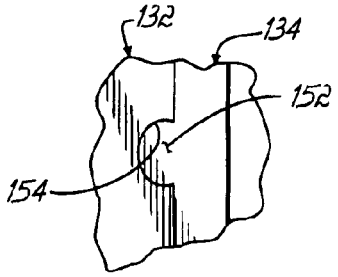
FIG. 9 is a broken-away side view of the fastenings means holding together the base and back plate of FIG. 8.

Column 3, line 44, reads: "Fig. 9 is a broken-away side view of the fastenings means"; it should read: -- Fig. 9 is a broken-away side view of the fastening means --.

Column 7, line 20, Claim 8, reads: "a shell having a pair of side waits and a pair of end walls;"; it should read: -- a shell having a pair of side walls and a pair of end walls; --.

Column 7, line 55, Claim 10, reads: "a fist attachment element adapted to be operably associated with the shell; and"; it should read: -- a first attachment element adapted to be operably associated with the shell; and --.

Column 8, line 40, Claim 17, reads: "the apparatus of claim 23 wherein said at least one groove"; it should read: -- wherein said at least one groove --.

Signed and Sealed this

Thirtieth Day of September, 2008

JON W. DUDAS
*Director of the United States Patent and Trademark Office*